United States Patent [19]

Beere

[11] 4,304,367

[45] Dec. 8, 1981

[54] PAPER ROLL HOLDER

[76] Inventor: Michael P. Beere, 1801 Blakefield Cir., Timonium, Md. 21093

[21] Appl. No.: 105,236

[22] Filed: Dec. 19, 1979

[51] Int. Cl.[3] ..... B65H 19/00

[52] U.S. Cl. ..... 242/55.2

[58] Field of Search ..... 242/55.2, 55.3, 55.53, 242/129.6–129.8

[56] References Cited

U.S. PATENT DOCUMENTS

| | | | |
|---|---|---|---|
| 2,441,740 | 5/1947 | Worley | 242/55.2 |
| 2,486,678 | 11/1949 | Rashko | 242/55.2 |
| 2,513,699 | 7/1950 | Williams | 242/55.2 |
| 2,582,036 | 1/1952 | Hill | 242/55.2 |
| 2,603,426 | 7/1952 | Hackney | 242/55.2 |
| 2,658,690 | 11/1953 | Hill | 242/55.2 |
| 2,879,932 | 3/1959 | McCachren | 225/89 |
| 3,249,313 | 5/1965 | Hackney | 242/55.2 |
| 3,454,236 | 7/1969 | Shaver et al. | 242/55.2 |
| 4,102,510 | 7/1978 | Anderson | 242/55.2 |

FOREIGN PATENT DOCUMENTS

| | | | |
|---|---|---|---|
| 1072504 | 2/1980 | Canada | 242/55.2 |
| 631462 | 11/1949 | United Kingdom | 242/55.2 |

*Primary Examiner*—Leonard D. Christian

*Attorney, Agent, or Firm*—Shlesinger, Arkwright, Garvey & Dinsmore

[57] ABSTRACT

A paper roll holder having a roll supporting member for engaging the core of a paper roll, the supporting member having a planar main portion adapted to be disposed generally parallel to and adjacent a diameter of the paper roll core, lateral flanges extending from the main portion at each side of the main portion over most of the length of the main portion, each flange being disposed at an angle equal to or slightly less than 90° with respect to the main portion, and an arcuate area encompassing the juncture of the main portion and each flange defining a shoulder for engaging the paper roll core, the main portion being of such a width that each arcuate area continuously engages the paper roll core for applying frictional pressure to the paper roll core whereby paper delivery is limited in that the paper roll core is only capable of limited rotation on the supporting member.

10 Claims, 4 Drawing Figures

PAPER ROLL HOLDER

BACKGROUND OF THE INVENTION

This invention is concerned with an improved holder for paper rolls such as toilet paper rolls and paper towel rolls and, in particular, an improved holder which prevents vandalism and wastage of paper.

A freely rotating roll on a holder often results in a user's taking more paper than is really needed. In addition, paper rolls can easily be taken from their holders unless measures are taken. One device for dealing with these problems is disclosed in U.S. Pat. No. 2,658,690 to Hill in which a paper holder includes a planar member having a width substantially wider than the diameter of the paper roll core to be mounted on it. This requires the roll core to be deformed into a generally elliptical shape for mounting on the device causing the planar member edges to grip the inside of the roll core with the result that the roll cannot be rotated at all and paper can be removed therefrom by unwinding only a small portion at a time. Additionally, once the holder is closed with a roll mounted thereon, the roll cannot be removed without damaging the roll. After the paper is used up, the device is opened to add the next roll by tearing the cardboard core off first.

SUMMARY OF THE INVENTION

An object of this invention is to provide a paper roll holder which will limit the ability of a paper roll thereon to rotate so as to prevent waste of paper.

An object of this invention is to provide a paper roll holder which conserves paper by limiting the ability of a paper roll thereon to rotate without entirely preventing rotation of the roll.

An object of the invention is to provide a paper holder which permits only limited rotation of a paper roll thereon by engaging the interior of the paper roll core in such a manner as to cause frictional resistance to rotation of the roll without entirely stopping the roll.

Another object of this invention is to provide a paper roll holder which permits only limited rotation of a paper roll while also preventing removal of the roll from the holder.

These objects and others which will become apparent from a reading of the following description are achieved by a paper roll holder having a roll supporting means for engaging the core of a paper roll and thereby supporting the paper roll, the supporting means comprising: a member adapted to extend through the paper roll core, the member having a planar main portion adapted to be disposed generally parallel to and adjacent a diameter of the paper roll core; the member also having lateral flanges extending from the main portion at each side of the main portion over most of the length of the main portion, each flange being disposed at an angle equal to or slightly less than 90° with respect to the main portion; and, an arcuate area encompassing the juncture of the main portion and each flange, each arcuate area defining a shoulder for engaging the paper roll core, the main portion being of such a width that each arcuate area continuously engages the paper roll core for applying frictional pressure to the paper roll core whereby paper delivery is limited in that the paper roll core is only capable of limited rotation on the supporting means.

The member adapted to extend through the paper roll core comprises two segments, each segment being insertable in the paper roll core at one end thereof and including means for detachably latching the segments together within the paper roll core.

The means for detachably latching the two segments comprises: an aperture adjacent the end of one of the two segments; and, a right angled tongue member at the end of the other of the two segments engageable with the aperture when the ends are brought into overlapping engagement causing the tongue member to slide along the end having the aperture and to snap into the aperture.

The angle between each flange and the main portion of the support member is between 87° and 90° and preferably is 88°.

DETAILED DESCRIPTION

Figure 1:
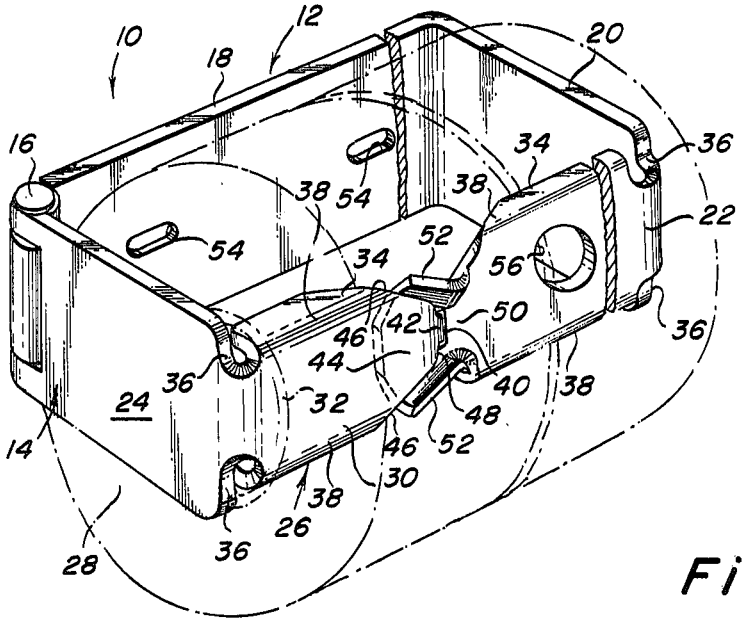
FIG. 1 is a perspective view of a paper roll holder according to the invention.
Figure 2:
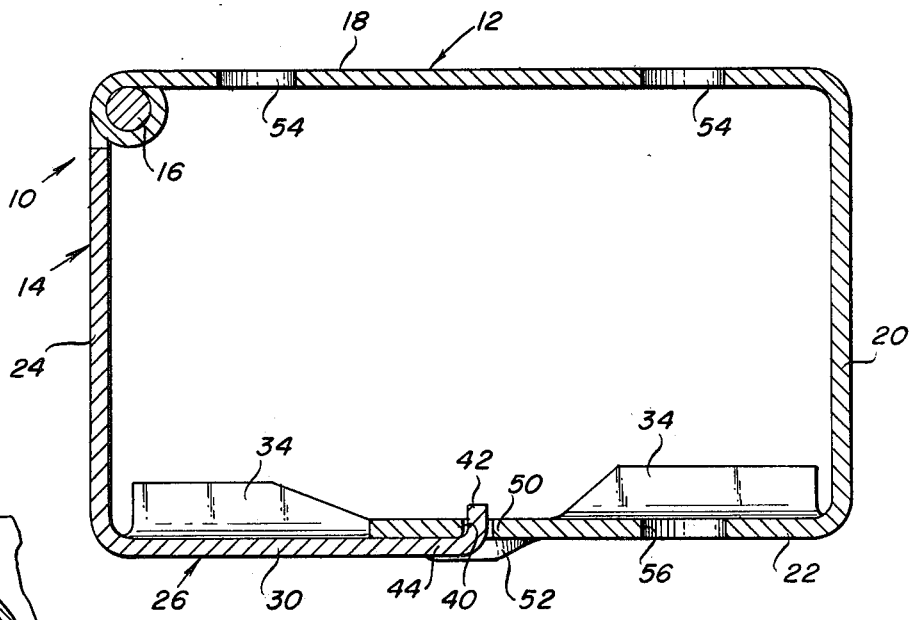
FIG. 2 is a sectional view of a paper roll holder according to the inventi0n.
Figure 4:
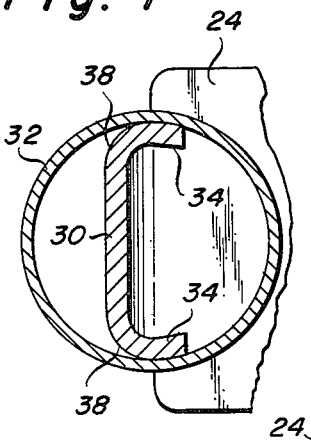
FIG. 4 is an enlarged sectional view taken along the line 4—4 of FIG. 3.
Figure 3:
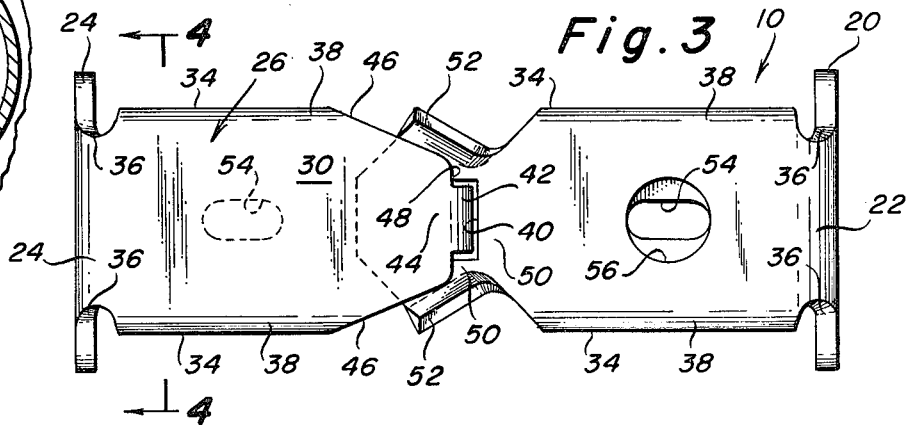
FIG. 3 is a front elevational view of the paper roll holder of FIG. 2.

Referring to the figures, a paper roll holder 10 is shown having two arms, a stationary arm 12 and a movable arm 14. The two arms 12, 14 are connected at a hinged joint 16 whereby one may be pivoted with respect to the other.

The stationary arm 12 is formed from a plate material and has three planar segments; a first segment 18 adjacent the hinged joint 16, a second segment 20 connected to the first segment 18 and perpendicular with respect thereto, and a third or end segment 22 perpendicular with respect to the second segment 20. The movable arm 14 is also formed from a plate material and has two planar segments: a segment 24 adjacent the hinged joint 16 and an end segment 26 perpendicular with respect to the segment 24.

The two arms 12, 14 thereby form a generally rectangular frame with the segment 18 comprising the back member of the frame, the segments 20 and 24 comprising the side members of the frame, and the end segments 22 and 26 comprising the front member which is adapted to extend through the paper roll 28 and engage and support the paper roll 28.

Each end segment 22, 26 has a main portion 30 adapted to be disposed generally parallel to and adjacent a diameter of the paper roll core 32. Located at each side of each main portion 30 over most of the length of each main portion 30 are lateral flanges 34 extending from the main portions 30 and disposed at an angle equal to or slightly less than 90° with respect to the main portions 30. Notches 36 are provided to permit the flanges 34 to be folded over during the manufacturing process. The connection between the main portions 30 and the flanges 34 is not abrupt but the main portions 30 blend into the flanges 34 so as to define an outwardly facing arcuate surface area 38 encompassing the outside juncture of each main portion 30 and each flange 34.

Located at or near the ends of the stationary arm 12 and the movable arm 14, which when the holder 10 is closed come into overlapping engagement, are members for detachably latching the two segments 22, 26 and consequently the two arms 12, 14 together. These comprise an aperture 40 adjacent the end of the stationary arm 12 and a right angled tongue member 42 at the end of the movable arm 14 so positioned that, due to the orientation of the hinge 16 perpendicular to the longitudinal axes of the arms 12, 14 resulting in the movable arm 14 pivoting laterally with respect to the stationary arm 12 into endwise engagement with the stationary arm 12, the tongue member 42 makes contact with and slides along the surface of the end of the stationary arm 12 until it snaps into the aperture 40. The holder 10 is made of resilient material, preferably a metal such as aluminum or spring steel, to make this action possible. While the aperture 40 has been described as being on the stationary arm 12, and the tongue member 42 as being on the movable arm 14, the positions may be reversed.

The end portion 44 of the segment 26 is tapered having converging side edges 46 and a perpendicular end edge 48 upon which is located the tongue member 42. The end portion 50 of the segment 22 is provided at its converging side edges with elongated guard flanges 52, these guard flanges 52 being disposed laterally of the aperture 40 and in a position to be adjacent the converging side edges 46 of the end portion 44 when the holder 10 is closed. The guard flanges 52 thus act as guiding elements when the holder 10 is closed to direct the tongue member 42 into the aperture 40. This aperture 40 and tongue 42 latch cannot be opened when the holder 10 is closed with a roll 28 thereon without destroying the roll 28. Opening of the holder 10 can only be effected when only the core 32 remains at which point the core 32 is torn off. Since the guard flanges 52 are adjacent the converging side edges 46 and since the aperture 40 and tongue 42 latch is spaced from either end of the roll 28 mounted thereon, this arrangement acts to prevent tampering with the holder 10 and removal of the roll 28 because a screw driver or other instrument cannot be inserted between the overlapping end portions 44 and 50.

In use one end segment 22, 26 is inserted into each end of the paper roll core 32. The arcuate areas 38 provide shoulders for the paper roll core 32 to rest on and the main portion 30 of each segment 22, 26 has a width such that the lateral distance between laterally opposed arcuate areas 38 is equal to or slightly greater than the diameter of the roll core 32 with which the main portion 30 is used. The main portion 30 of each segment 22, 26 lies generally parallel to and adjacent a diameter of the paper roll core 32 and the arcuate surface areas of each pair of laterally opposed shoulders 38 lie generally on a diameter of the paper roll core 32 thereby being diametrically opposed. Thus generally diametrically opposed surface areas of the cardboard core 32 are in engagement with and supported by both arcuate areas of shoulders 38 of both segments 22, 26. By this arrangement the shoulders 38 continuously engage and apply frictional pressure to the interior of the core 32 and thus limit the rotation of the core 32 so as to limit paper delivery. The width of the main portions 30 is carefully preset so that the shoulders 38 do not on the one hand create too much friction and totally prevent rotation nor on the other hand permit free unhindered rotation of the roll 28.

The flanges 34 are disposed at an angle with respect to their respective main portions 30 equal to or slightly less than 90° so that the ends of the flanges 34 will not bite into the roll core 32. Generally the preferred range for this angle is between 87° and 90° although optimally an angle of approximately 88° is desirable.

In a holder according to this invention built for use with a paper roll having a cardboard core 32 with a diameter of 1½ inches, end segments 22, 26 were provided having a width of 1½ inches from one arcuate shoulder 38 to the other. The height of each flange 34 was one half inch from base to tip and the width of the other segments of the rectangular frame was two inches.

The overall length of the rectangular frame comprising the members 18, 20, 22, 24 and 26 is not critical and may vary depending on the width of the rolls with which the holder is to be used.

Situated in the first segment 18 of the stationary arm 12 are two oblong apertures 54 by which the holder 10 may be mounted on a suitable support using, for instance, screws. Located in the end segment 22 of the stationary arm 12 is an aperture 56 which facilitates positioning of a screw driver.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What is claimed is:

1. In a paper roll holder, a roll supporting means for engaging the core of a paper roll and thereby supporting the paper roll, said supporting means comprising:

a member adapted to extend through the paper roll core, said member having a planar main portion adapted to be disposed generally parallel to and adjacent a diameter of the paper roll core;

said member also having a lateral flange extending from said main portion at each side of said main portion over most of the length of said main portion, each said flange being disposed at an angle equal to or slightly less than 90° with respect to said main portion;

an outwardly facing arcuate surface area encompassing the outside juncture of said main portion and each said flange, each said outwardly facing arcuate surface area defining a shoulder for engaging the paper roll core, said outwardly facing arcuate surface areas lying generally on a diameter of the paper roll core thereby being diametrically opposed; and, said main portion being of such a width that each of said outwardly facing arcuate surface areas continuously engages a surface area of the paper roll core at generally diametrically opposed locations on the paper roll core for continuously applying frictional pressure to the paper roll core whereby paper delivery is continuously limited in that the paper roll core is only capable of limited rotation on said supporting means.

2. The roll supporting means of claim 1 wherein the angle between each said flange and said main portion is between 87° and 90°.

3. The roll supporting means of claim 1 wherein the angle between each said flange and said main portion is 88°.

4. The roll supporting means of claim 1 wherein said member adapted to extend through the paper roll core comprises two segments, each segment being insertable in the paper roll core at one end thereof and including means for detachably latching said segments together within the paper roll core.

5. The roll supporting means of claim 4 wherein said means for detachably latching said two segments comprises:

an aperture adjacent the end of one of said two segments; and, a right angled tongue member at the end of the other of said two segments engageable with said aperture when said ends are brought into overlapping engagement causing said tongue member to slide along said end having said aperture and to snap into said aperture.

6. A paper roll holder, comprising:

a generally rectangular frame having a stationary arm and a movable arm connected to said stationary arm at a hinged joint whereby said movable arm may be pivoted with respect to said stationary arm;

said stationary arm having at its end removed from said joint a planar end segment adapted to be inserted into one end of a paper roll core;

said movable arm having at its end removed from said joint a planar end segment adapted to be inserted into the other end of the paper roll core;

means on said stationary arm end segment and on said movable arm end segment for detachably latching said end segments together within the paper roll core, said end segments when latched extending through the paper roll core and forming a member for engaging and supporting the paper roll core;

said end segments each having a main portion adapted to be disposed generally parallel to and adjacent a diameter of the paper roll core;

each said end segment also having a lateral flange extending from its main portion at each side of said main portion over most of the length of said main portion, each said flange being disposed at an angle equal to or slightly less than 90° with respect to said main portion;

an outwardly facing arcuate surface area encompassing the outside juncture of each said main portion and each said flange, each said outwardly facing arcuate surface area defining a shoulder for engaging the paper roll core with laterally opposed pairs of said outwardly facing arcuate surface areas on each said end segment lying generally on a diameter of the paper roll core thereby being diametrically opposed to one another; and, each said main portion being of such a width that each of said outwardly facing arcuate surface areas of each said main portion continuously engages a surface area of the paper roll core at generally diametrically opposed locations on the paper roll core for continuously applying frictional pressure to the paper roll core whereby paper delivery is continuously limited in that the paper roll core is only capable of limited rotation on said paper roll engaging and supporting member.

7. The paper roll holder of claim 6 wherein:

said stationary arm has a first planar segment adjacent said hinged joint comprising the back member of said rectangular frame and a second planar segment between said first segment and said end segment of said stationary arm, said second segment comprising one side member of said rectangular frame; and, said movable arm has a planar segment between said hinged joint and said end segment of said movable arm comprising the other side member of said rectangular frame.

8. The paper roll holder of claim 6 wherein said means for detachably latching said end segments comprises:

an aperture adjacent the end of one of said stationary arm and said movable arm; and, a right angled tongue member at the end of the other of said stationary arm and said movable arm engageable with said aperture when said ends are brought into overlapping engagement by said movable arm being pivoted with respect to said stationary arm so as to cause said tongue member to slide along said end having said aperture and to snap into said aperture.

9. The paper roll holder of claim 6 wherein the angle between each said main portion and each of its flanges is between 87° and 90°.

10. The paper roll holder of claim 6 wherein the angle between each said main portion and each of its flanges is 88°.

* * * * *